United States Patent [19]

Tsuruoka

[11] Patent Number: 4,748,473

[45] Date of Patent: May 31, 1988

[54] PRINTING APPARATUS WITH DETACK DEVICE

[75] Inventor: Ryoichi Tsuruoka, Hongo Ebina, Japan

[73] Assignee: Rank Xerox Limited, London, England

[21] Appl. No.: 919,728

[22] Filed: Oct. 16, 1986

[30] Foreign Application Priority Data

Oct. 21, 1985 [JP] Japan ..... 60-233409
Oct. 21, 1985 [JP] Japan ..... 60-233410
Oct. 21, 1985 [JP] Japan ..... 60-233412

[51] Int. Cl.[4] ..... B65H 29/56

[52] U.S. Cl. ..... 355/14 SH; 355/14 TR; 355/15; 355/3 TR; 271/308; 271/311; 271/900

[58] Field of Search ..... 355/3 SH, 3 TR, 15, 355/14 SH, 14 TR; 271/308–311, 900; 403/154, 329; 384/428; 29/453

[56] References Cited

U.S. PATENT DOCUMENTS 3,253,480 5/1966 Fernberg ..... 384/428 X
3,307,291 3/1967 Cremer ..... 384/428 X
3,422,720 1/1969 Johnson ..... 384/428 X
3,985,436 10/1976 Tanaka et al. ..... 355/3 DD X
4,072,307 2/1978 Knieser ..... 355/3 R X
4,470,689 9/1984 Nomura et al. ..... 355/3 DR X

FOREIGN PATENT DOCUMENTS 54-133141 10/1979 Japan .
56-133778 10/1981 Japan .
57-168280 10/1982 Japan .
58-98765 6/1983 Japan .
59-29281 2/1984 Japan .
59-87474 5/1984 Japan .
60-95469 5/1985 Japan .

*Primary Examiner*—Patrick R. Salce
*Assistant Examiner*—Emanuel Todd Voeltz

[57] ABSTRACT

A compact, inexpensive paper detack device has a detack claw mounted to the bottom of a cleaning assembly has a rotatably mounted shaft supporting the detack claw, a pair of shaft support members extending downward from the cleaning housing each having a recess in its lower corner adjacent the imaging member for supporting the shaft and at least one elastic support member extending downward from the cleaning assembly in cooperative association with the pair of shaft support members pressing the shaft into the recess. The elastic support member has a tip bent forward toward the shaft forming a bearing space between the recess and the tip smaller than the diameter of the shaft to provide a snap fit for the shaft on insertion into the bearing between the recess and the elastic support member. The detack claw has an elastomeric tip and the angle between the bottom of the claw and the tangent at the contact point between the detack claw and the drum is between 120° and about 140°. The detack claw is attached to an axially slidable member rotatably mounted to the shaft having a groove therein for removing foreign matter entering the space between the shaft and the axially slidable member.

20 Claims, 5 Drawing Sheets

PRINTING APPARATUS WITH DETACK DEVICE

BACKGROUND OF THE INVENTION

The present invention relates to electrostatographic printing apparatus and more particularly to devices for detacking a copy sheet, onto which a toner image has been transferred from an imaging member, from the imaging member.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Many commercial applications of the above process employ a modular concept for the various processing stations. For example, the imaging member, developer assembly and cleaner assembly may be combined in a single unit or cartridge which has a limited life at the end of which it may be discarded and replaced with a new unit or cartridge. Alternatively, a charging device may be added to the unit or the unit may contain either of the developer or the cleaner.

For example, U.S. Pat. No. 3,985,436 (Tanaka et al.) describes a copying apparatus in which an imaging member, developing device and cleaner may be incorporated in a casing as one unit to be releasably inserted into the main apparatus housing.

U.S. Pat. No. 4,470,689 (Nomura et al.) also describes such a unit which is provided with a movable protection cover for protecting the image bearing member and illustrates in FIGS. 15A–15F several different alternative of process elements which may be included in such a process unit.

In many commercial applications it is desirable to provide assistance in physically separating the copy sheet bearing the toner image from the imaging member since the copy sheet may be tacked to the imaging member and which if not separated, may enter the cleaner housing resulting in a paper jam, loss of copy and contamination of the machine by toner displaced from the cleaner.

Well known detacking devices include a device for detacking the paper from the photoreceptor by suction, a detacking belt for holding an edge of the copy paper away from the imaging member, self stripping suitable for photoreceptor belts where the belt goes around a very small radius and the beam strength of the paper separates it from the belt, and a device having a claw with its tip abutting the photoreceptor for detacking the paper.

However, the suction detacking device is large and expensive so that its applications are limited to very high volume machines despite its excellent detacking property. Similarly, the belt strip has excellent detacking reliability, but an edge of the copy paper is blanked out because of its contact with the belt, making faithful reproduction impossible. The self strip requires no special detacking means and is inexpensive, but it has poor detacking reliability especially for tracing paper that is very thin. The detacking device with a claw is less expensive than the other three types and is able to produce a faithful copy, and give satisfactory detacking reliability by selecting the proper shape, material, number, and mounting method of claws so that it is widely used today.

PRIOR ART

FIGS. 8 and 9, and Japanese Patent Kokai No. 54-133141 illustrate typical detacking devices 10 with a claw 23 provided between the transfer assembly 12, which includes transfer corotron 18 and detack corotron 19, and the cleaning assembly 14 for cleaning the photosensitive drum 11 which rotates in the direction of the arrow past the processing stations including developer 20. The detack claw 23 is rotatably attached at its base to the bracket 13 secured to the bottom of cleaning assembly 14 and brought into contact at its free end with the photosensitive drum 11 by gravity or a spring for detacking the copy paper 21 from the drum 11 toward a transport belt 22.

This detacking device is secured by first screwing the bracket 13 to the bottom of cleaning assembly 14, inserting a shaft 15 of detack claw 23 into the bearings 16, and fastening the shaft with bushings 24 and E rings 17. The assembly of such a device is time consuming and complicated. In addition, it requires many parts, increasing the cost. Moreover, the bearings 16 of bracket 13 project downward, reducing the useful space below the cleaning assembly 14.

In addition, one of the most important factors to determine detacking performance is the sharpness of the tip of detack claw 23. It is believed that the detacking performance increases as the tip of the detack claw 23 becomes thinner or is much thinner than the thickness of paper and as the angle $\theta'$ between the tangent at a point where the detack claw 23 contacts the photosensitive drum 11 and the lower side of detack claw 23 increases or approaches 180°. However, the thickness of existing claw tips is above 20 microns and the angle $\theta'$ is in the range of 120° and 160° because of restrictions of the material. The existing detack claws 23 include a stainless-steel claw about 50 microns thick etched so that it will not damage the photosensitive drum, a plastic claw, and urethane rubber or other elastic material claw.

However, none of them is fully satisfactory, and it is a practice to cover up the low detacking performance by increasing the number of detack claws 23. While plastic or stainless-steel having high hardness may be used to enhance the detacking performance, they can damage the photosensitive drum 11, producing undesired white bands or black lines in the copy. In order to avoid this, Japanese Patent Kokai No. 59-87,747 has proposed a retractable detacking device brought into contact with the photosensitive drum only when its tip is used to detack the paper 21. However, the retractable detacking device requires a solenoid and a link mechanism, making it complicated and expensive.

Japanese U.M. Kokai No. 54-125,646 discloses a hard detack claw with its tip coated with a soft and wear resistant gummous material. However, the gummous coating must be sufficiently thick to avoid damage to the photosensitive drum, making the front edge rounded and thereby lowering detacking performance. Furthermore, the claw tip tends to be rolled in by the friction between the gummous coating and the photosensitive drum, causing damage to the photosensitive surface or accelerating wear of the claw tip, resulting in lower detacking performance or even claw breakdown.

In addition, a paper detack device of this type is usually mounted on the bottom of cleaning assembly so that some of the toner falling from the cleaning assembly or scraped from the photosensitive drum by the detack claw adheres to the shaft, bearings, or bushing provided between the detack claw and the shaft or even enters spaces between the bearings and the shaft or the shaft and the bushing, making rotation of the shaft or detack claw difficult. This is especially so since the space between the shaft and the bushing is set at a range of tens of microns to 150 microns to keep the edge of the detack claw parallel to the photosensitive drum with constant pressure so that any toner entering this space can immediately make rotation of the detack claw difficult, changing the pressure and causing a paper jam. Furthermore, when the tip of the detack claw is stopped away from the photosensitive drum, it can contact the toner image on the copy causing a white blank or black lines on the copy.

Japanese Patent Kokai No. 60-95,469 suggests one solution to the problem by providing escapes on the bearing surfaces of bearings for letting the toner or other foreign objects escape. Since the toner or other foreign objects entering a space between the shaft and the bearings are collected in the escapes, there will be no clogging of the space thus keeping the detack claw from being blocked.

However, when this device is used for a long period of time, the escapes on the bearings are filled with toner or other foreign objects so that the detack claw can still be blocked from rotating. Consequently, it is necessary to periodically remove the toner or other foreign objects accumulating in the escapes. Since the escapes are provided on the inside of bearings, the shaft must be pulled out of the bearings before cleaning. As a result, every time the device is cleaned it must be disassembled and then assembled again, a troublesome maintenance task.

SUMMARY OF THE INVENTION

In a principle aspect of the present invention a compact inexpensive paper detack device with a detack claw is provided which has a minimum of parts to assemble and is readily detached and replaced.

In a further principle aspect of the present invention, a paper detacking apparatus is provided which can be maintaind in contact with the imaging member without damaging it.

In a further aspect of the present invention an easy maintenance detack device is provided which is maintained free of toner and other foreign objects which may interfere with its operation.

In a further aspect of the present invention a paper detack device having a detack claw is mounted to the bottom of a cleaning assembly such that the tip of the claw is brought into contact with the imaging member detacking a copy sheet has a rotatably mounted shaft supporting the detack claw, a pair of shaft support members extending downward from the cleaning housing each having a recess in its lower corner adjacent the imaging member for supporting the shaft and at least one elastic support member extending downward from the cleaning assembly in cooperative association with the pair of shaft support members pressing the shaft into the recess.

In a further aspect of the present invention a pair of elastic support members are positioned intermediate the pair of shaft support members on the side opposite the shaft.

In a further aspect of the present invention, the elastic support member has a tip bent forward toward the shaft forming a bearing space between the recess and the tip smaller than the diameter of the shaft to provide a snap fit for the shaft on insertion into the bearing between the recess and the elastic support member.

In a further aspect of the present invention, the imaging member is a rotatable drum which is mounted together with the cleaning assembly in cooperative association as a processing unit.

In a further aspect of the present invention, the detack claw has an elastomeric tip and the angle between the bottom of the claw and the tangent at the contact point between the detack claw and the drum is between 120° and about 140°.

In a further aspect of the present invention, the detack claw is attached to an axially slidable member rotatably mounted to the shaft having a groove therein for removing foreign matter entering the space between the shaft and the axially slidable member.

DESCRIPTION OF THE PREFERRED EMBODIMENTS

According to the invention, the shaft of a detack claw is very easy to attach by simply snapping it into a space between the first support members and the second elastic support members. Some parts, such as E rings are eliminated, reducing the manufacturing cost and time. Furthermore, the useful space below the cleaning assembly is larger. In addition, the transferred paper may be reliably detacked from the photosensitive drum without damaging the photosensitive surface by having the tip of the detack claw of an elastomeric material and making the proper angle between the lower side of the claw tip and the tangent to the photosensitive drum at the contact point with the detack claw. Further according to the invention, toner or other foreign objects entering the space between the shaft and the sliding member are collected in the groove as the shaft or sliding member is rotated so that there is little or no possibility of clogging the space with toner, thereby permitting the detack claw to rotate its tip into contact with the photosensitive drum with a predetermined pressure. In addition, the groove can be exposed by simply shifting the shaft or sliding member in the axial direction so that cleaning is easy to perform without disassembling the device, thus making maintenance simple and the detack function stable for a long period of time.

Figure 1:
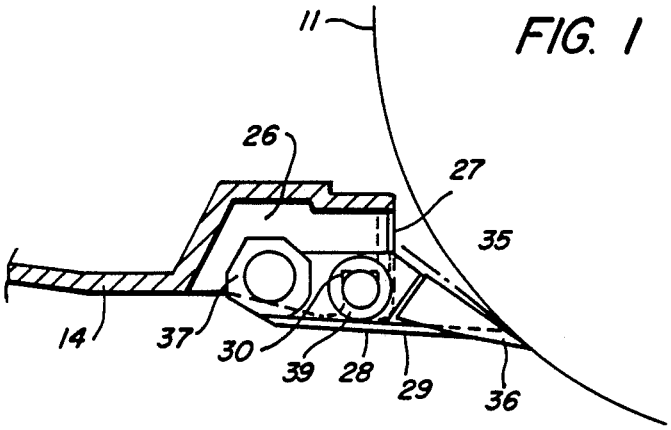
FIG. 1 is a sectional view of a paper detack device embodying the present invention.
Figure 2:
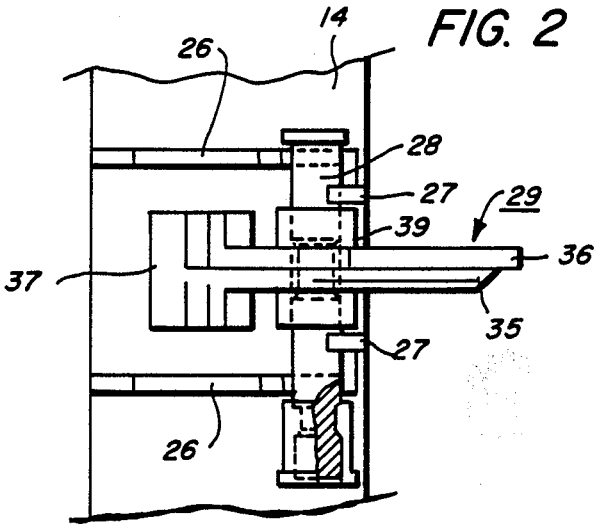
FIG. 2 is a bottom view of the device of FIG. 1.

Referring now to FIGS. 1 through 7 there is shown a paper detack device embodying the present invention. This detack device consists of a pair of first support members 26 and a pair of second support members 27, extending downward from the bottom of the cleaning assembly 14 facing a photosensitive drum 11, a shaft 28 supported by these support pieces, and a detack claw 29 rotatably mounted on the shaft 28 with a bushing 39. As FIGS. 1 and 2 show the first support members 26 are made of a pair of parallel plates extending downward from the cleaning assembly 14 an appropriate distance in the direction of shaft 28. A pair of L-shaped or right angled recesses 30 are provided on the lower corners of support members 26 adjacent the photosensitive drum 11.

Figure 4:
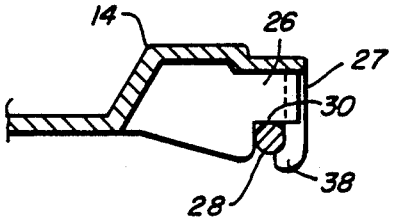
FIG. 4 is a sectional view of the first and second support pieces of the above device.
Figure 5:
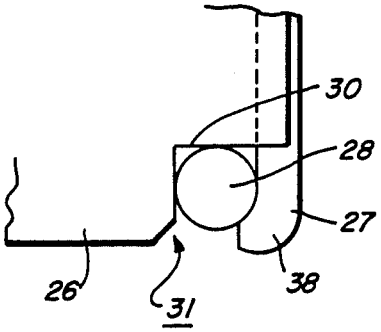
FIG. 5 is an enlarged view of part of FIG. 4.

The second support members 27 are made of plastic or other elastic material and also extend downward from the cleaning assembly 14 spaced a distance in the direction of shaft 28. As FIGS. 4 and 5 show the tip of the elastic support members has a shaft holding projection 38 which is slightly bent toward the shaft 28 forming a bearing 31 with the recess 30. The space between the recess 30 and the tip of second support member 27 is slightly smaller than the diameter of shaft 28 so that when the shaft member 27 is snapped into the bearing 31, it is pressed against the recess 30 by an elastic force of second support member 27. As FIG. 2 shows, the first and second support members 26 and 27 are offset in the axial direction of shaft 28 so that they may support the shaft at four different points, thus assuring a firm grip of the shaft. While two elastic support members intermediate the pair of first support members are illustrated, it will be understood that the cooperative association between the first path of support member and the elastic support member for pressing the shaft into the recess may be accomplished with only one such member.

Figure 6A:
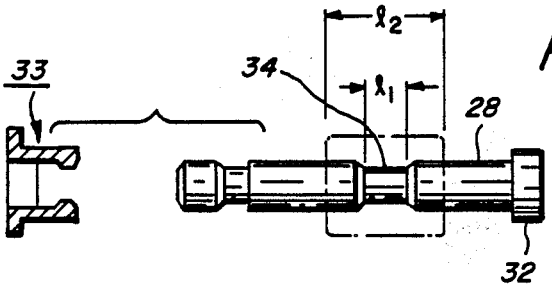
FIG. 6*a* is a plan view of the shaft for the device.
Figure 6B:
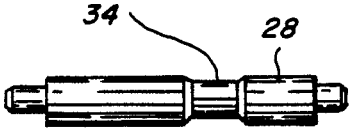
FIGS. 6*b*, 6*c* and 6*d* are plan views of other embodiments of the shaft.
Figure 6C:
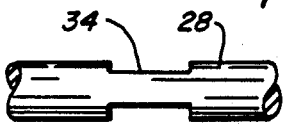
Figure 6D:
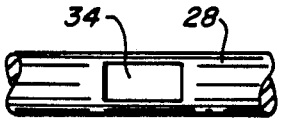

The shaft 28 may be made of stainless-steel with its surface finished. As FIG. 6*a* illustrates, shaft 28 has a flange 32 at an end and the other end is designed to fit into a stopper 33 to prevent separation of the shaft. Alternatively, as FIG. 6*b* illustrates the material of elastic support member may be selected so that its pressure to the first support member is increased sufficiently to eliminate the need for the flange and stopper, and the ends of the shaft may be reduced in diameter. Moreover, the shaft 28 may be a straight column and separation from the supports can still be prevented. A groove 34 is provided at the central portion of shaft 28 to remove toner or other foreign objects entering between the bushing 39 and the shaft 28. The width ($l_1$) of groove 34 should be as large as possible relative to the length ($l_2$) of bushing 39 so that the noncontact area between the shaft 28 and the bushing 39 may be larger than the contact area, thereby reducing the friction. Alternatively, as illustrated in FIGS. 6*c* and 6*d* an intermittent groove 34 may be provided on the shaft 28.

Foreign objects, such as toner, entering the space between the shaft 28 and the bushing 39 are collected in the groove 34 as the bushing 39 rotates, thus preventing the space from being clogged with the foreign objects. The detack claw 29 is rotated without any difficulty so that its tip comes into contact with the photosensitive drum 11 with a predetermined pressure, producing a reliable detacking effect. The groove 34 of shaft 28 can be exposed by shifting the detack claw 29 along the shaft 28 so that the foreign objects may be easily removed from the groove without disassembling the device. When the detack claw reciprocates along the shaft 28, the foreign objects are automatically removed from the groove 34 every time the detack claw moves, thus eliminating the above cleaning operation.

Figure 3:
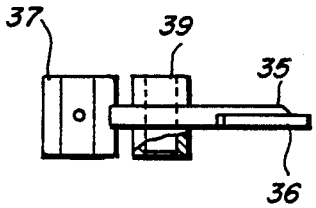
FIG. 3 is a plan view of the detack claw of the above device.

As FIGS. 1 through 3 illustrate the detack claw 29 consists of a support member 35 rotatably mounted on the shaft 28 and a claw member 36 secured to the tip of support member 35 for contact with the photosensitive drum 11. The support member 35 is made of a strong material, such as ABS resin or polycarbonate resin, and, as FIG. 3 illustrates the support member 35, has at its central portion the bushing 39 fitted over the shaft 28. The preferred tolerance between the bushing and the shaft ranges from 50 to 70 micron. If the tolerance is below the above limit, the fitting between the shaft and the support member is so tight that the slightest disturbance can make the rotation of detack claw impossible. If the tolerance is above the limit, there will be too much play to keep the edge of detack claw parallel to and in contact with the photosensitive drum owing to vibrations of the photosensitive drum or cleaning assembly, thus impairing detack performance.

The claw members 36 may be made of any suitable material such as stainless-steel or other metal, polyamide based plastic, or preferably an elastomeric material such as polyurethane rubber having a rubber hardnes of 70° to 98°, Hardness test—Type A in Japanese Industrial Standard (JIS K6301—1975). Where the claw member is made of plastic, it may be formed integrally with the support member 35. As FIGS. 1 and 2 illustrate, a weight 37 is embedded in the end of support member 35 opposite to the claw member 36 so that the tip of claw member 36 may contact the photosensitive drum 11 with a pressure of 0.3 grams to 3 grams. Where there is a large space below the cleaning assembly 14, the length of support member 35 from the shaft 28 may be made sufficiently large to provide a necessary pressure without using the weight 37.

With the detack device according to the invention, the shaft 28 of detack claw 29 may be snapped firmly into the bearings 31 defined by the first and second support members 26 and 27 secured to the bottom of the cleaning assembly so that its attachment or replacement is much simpler than the prior art. In addition, the support members are simpler in structure and lower in cost than the bracket or other parts in the prior art device. The claw member 36 preferably is made of an elastomeric material such as polyurethane rubber because of their excellent elasticity, wear resistance, and ozone resistance. Although the support member and claw member may be integrated of polyurethane rubber, the rotary friction becomes so large that there will be a need for low friction bearings. Accordingly, it is preferred to make them separately.

Figure 7:
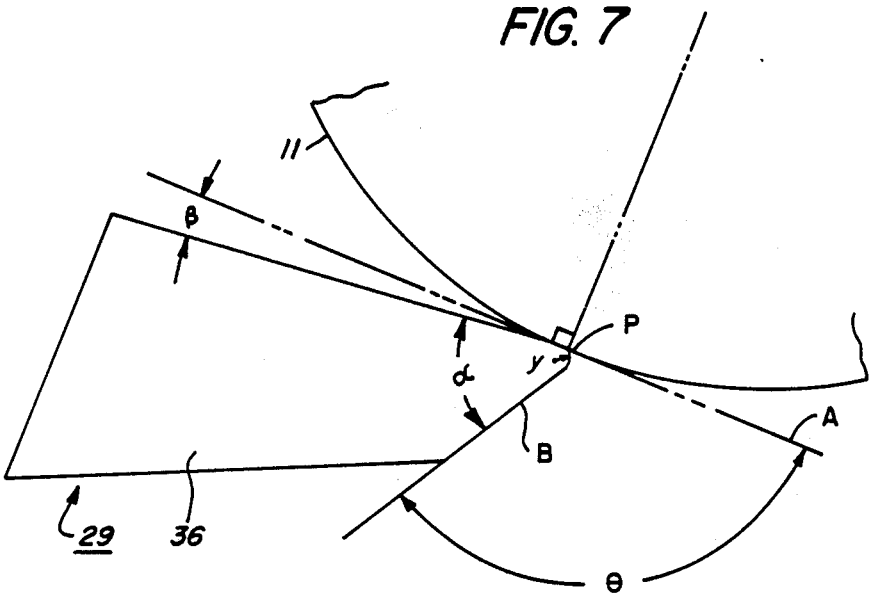
FIG. 7 is an enlarged view of the claw tip illustrating it in relation to the photosensitive drum.
Figure 8:
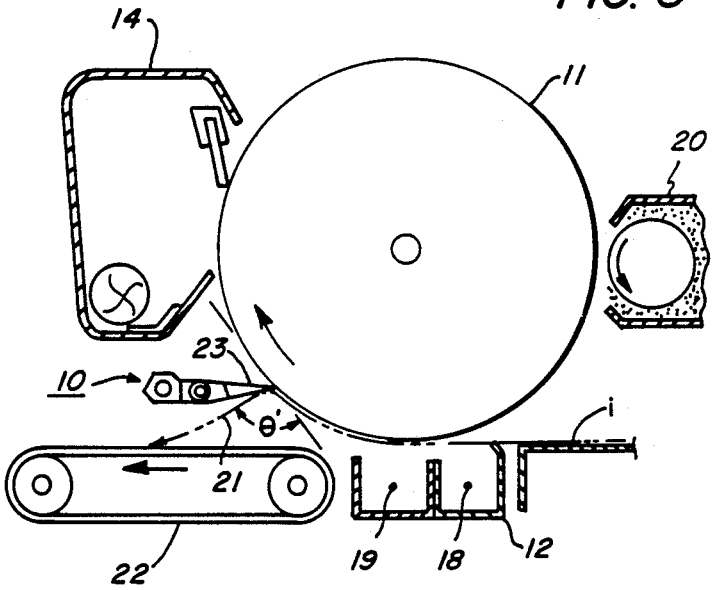
(PRIOR ART) FIG. 8
FIG. 8 is a sectional view of the prior art paper detack device.
Figure 9:
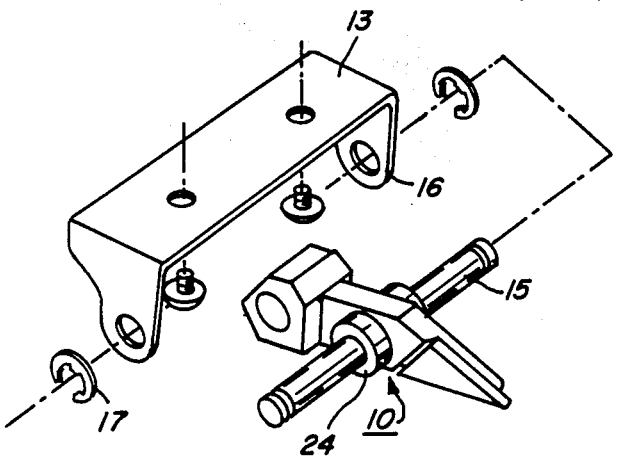
(PRIOR ART) FIG. 9
FIG. 9 is an exploded perspective view of the prior art detack claw.

The shape of detack claw and the relation between the detack claw and the photosensitive drum will be described with reference to FIG. 7. The radius of curvature y of the tip of detack claw, which sould be generally small, must be smaller than the thickness of paper used. The preferred radius is below 20 microns for producing good detack effects for almost all types of paper. The angle $\theta$ between the tip of detack claw and the tangent A at a point P where the detack claw contacts the photosensitive drum should be large. If $\theta$ is below 120°, the paper hits the tip of detack claw, wearing or damaging it after many repetitions, resulting in poor detack performance. Although the claw member may be made integrally of polyurethane rubber, it is preferred to mold first only the tip of claw member and then cut it so that the radius of curvature y may be smaller. The width of claw member should be below 3 mm, preferably from 1 to 2 mm because the detack claw scrapes the untransferred toner from the photosensitive drum.

An evaluation of detack performance and damage to the photosensitive drum relative to the tip of angle $\alpha$ of the detack claw and the radius of curvature y provides the following. The cutting angle $\alpha$ and tip precision or radius of curvature y vary with the hardness of polyurethane rubber used to mold the tip of the claw member. For example, the limits of the angle at which the claw tip can be cut without breaking are determined at rubber hardness of 70°, 80°, 90° and 98°, the higher the rubber hardness, the sharper the claw tip cut without breaking. If the rubber hardness is low, the claw tip cut will not be sharp. Consequently, the rubber hardness affects the paper detacking performance and the degree of damage to the photosensitive drum.

Table I shows the test results for the detacking performance. In FIG. 7, B is the cut surface of the claw tip, y is the radius of curvature representing the precision of the tip, $\alpha$ is the angle of the tip front end, $\beta$ is the angle between the tangent A at P and the upper side of claw member, and the $\theta$ is the best angle between the tangent A and the cut surface B for detacking performance determined by $\alpha$ and $\beta$. 100 sheets of Super tracing paper (55 g/m$^2$) were run with a contact pressure of 2 grams, an angle $\beta$ of 5°, and the detack corotron off to observe whether the paper was detacked by the detack claw.

TABLE I

| Rubber Hardness | $\alpha$° | y microns | $\theta$° | Detacking performance |
|---|---|---|---|---|
| 70° | 85~60 | 15~40 | 90~115 | X |
| 80° | 70~50 | 10~30 | 105~125 | Δ |
| 90° | 55~40 | 3~20 | 120~135 | O |
| 98° | 50~30 | 3~20 | 120~135 | O |

Legend:
X: No good, misstripping rate greater than 20%.
Δ: Not so good, misstripping rate about 5%.
O: Good, misstripping rate 0%.

As is apparent from the above table, the angle $\alpha$ of the claw tip can be smaller and sharper by increasing the rubber hardness of detack claw. Consequently, the angle $\theta$ can be larger and the radius of curvature y of the claw tip can be smaller since there is little or no possibility of being broken, thus providing good detacking performance. The tip of the detack claw is very thin but will not deform under the contact pressure with the photosensitive drum because of its high hardness. Also, there is little or no possibility because of its firmness that the claw tip be rolled in by the rotating drum with the friction between the claw tip and the photosensitive drum. Moreover, the claw tip is not easy to deform elastically so that it always contacts the photosensitive drum in stable conditions. Rubber having a hardness of 70° to 90° may be put into practice without damaging the photosensitive drum, but if the rubber hardness is below 85°, detacking performance is reduced. Depending on the material of which photosensitive drum is made detack claws of stainless-steel or polyamide based plastics having extremely high hardness, while providing good detacking performance can damage the surface of photosensitive drum. From the test results for various rubbers, detacking performance was improved without damaging the photosensitive drum by molding the tip of detack claw of elastomeric material, such as polyurethane, having a rubber hardness of 85 to 98 and at an angle $\theta$ of 120° to 140°.

While the paper detack device has been illustrated as being attached to the bottom of the cleaning assembly, it will be understood that the cleaning assembly may be mounted in cooperative association with the imaging member and other assemblies such as, for example, the developer in the manner illustrated in U.S. Pat. Nos. 3,985,436 and 4,470,689 as discussed above.

According to the invention, since the shaft of a detack claw is held between the first and second support members secured to the bottom of the cleaning assembly, the attachment or replacement of a detack claw is very easy, the number parts is reduced resulting in lower manufacturing cost and making the space below the cleaning assembly larger.

Furthermore, the groove provided on the shaft of a detack claw so that the foreign objects entering the space between the shaft and the sliding member are collected in the groove, prevents clogging of the above space with foreign objects. The detack claw is rotated without difficulty so that its tip is brought into contact with the photosensitive drum with a predetermined pressure, maintaining good detack performance for a long period of time. In addition, the groove can be exposed by simply sliding the shaft or sliding member in the axial direction of the shaft so that the foreign objects deposited in the groove can be easily removed.

Further, with the tip of the detack claw made of an elastomeric material, the best angle between the cut surface of the tip and the tangent to the photosensitive drum may be achieved to assure detacking paper from the drum without damaging the photosensitive surface.

The disclosure of the patents referred to herein are hereby specifically and totally incorporated herein by reference.

While the invention has been described with reference to specific embodiment, it will be apparent to those skilled in the art that many alternatives, modifications and variations may be made. Accordingly, it is intended to embrace all such alternatives and modifications that may fall within the spirit and scope of the appended claims.

What is claimed is:

1. In a electrostatographic printing apparatus including an imaging member and a cleaning assembly, a paper detack device having a detack claw mounted on the bottom of the cleaning assembly such that the top of the claw is brought into contact with the imaging member detacking a copy sheet therefrom, said detack device including a rotatably mountable shaft supporting said detack claw, a pair of shaft support members extending downward from said cleaning assembly each having a recess in its lower corner adjacent said imaging member for supporting said shaft and at least one elastic support member extending downward from said cleaning assembly in cooperative association with said pair of shaft support members for pressing said shaft in said recess.

2. The apparatus of claim 1, including a pair of elastic support members positioned intermediate said pair of shaft support members on the side opposite said shaft.

3. The apparatus of claim 1, wherein said at least one elastic support member has a tip that is bent forward toward said shaft forming a bearing space between said recess and said tip smaller than the diameter of said shaft to provide a snap fit for said shaft on insertion into the bearing between the recess and the elastic support member.

4. The apparatus of claim 2, wherein each of said pair of elastic support members has a tip that is bent forward toward said shaft forming a bearing space between said recess and said tip smaller than the diameter of said shaft to provide a snap fit for said shaft on insertion into the bearing between the recess and the elastic support member.

5. The apparatus of claim 1, wherein said imaging member is a rotatable drum.

6. The apparatus of claim 1, wherein said cleaning assembly and said imaging member are mounted together in cooperative association as a processing unit.

7. The apparatus of claim 3, wherein said cleaning assembly and said imaging member are mounted together in cooperative association as a processing unit.

8. The apparatus of claim 4, wherein said detack claw comprises an elastomeric tip and the angle between the bottom of said detack claw and the tangent at the contact point between the detack claw and the drum is between about 120° and about 140°.

9. The apparatus of claim 8, wherein said elastomeric tip has a hardness of between about 85° to about 98°.

10. The apparatus of claim 4, wherein said detack claw is attached to a member which is axially slidable and rotatably mounted to said shaft, said shaft having a groove therein for removing foreign objects entering the space between said shaft and said axially slidable member.

11. The apparatus of claim 10, wherein said groove is a continuous circumferential groove on said shaft.

12. The apparatus of claim 10, wherein said groove is an intermittent groove on said shaft.

13. In a electrostatographic printing apparatus including a rotatable imaging drum and a cleaning assembly, a paper detack device having a detack claw mounted on the bottom of the cleaning assembly such that the top of the claw is brought into contact with the imaging member detacking a copy sheet therefrom, said detack device including a rotatably mountable shaft supporting said detack claw, a pair of shaft support members extending downward from said cleaning assembly each having a recess in its lower coroner adjacent said imaging member for supporting said shaft and at least one elastic support member extending downward from said cleaning assemblyin cooperative association with said pair of shaft support members for pressing said shaft in said recess, said detack claw comprising an elastomeric tip and the angle between the bottom of said detack claw and the tangent at the contact point between the detack claw and the drum is between about 120° and about 140°.

14. The apparatus of claim 13, wherein said elastomeric tip has a hardness of between about 85° to about 98°.

15. The apparatus of claim 13, wherein said detack claim is attached to a member which is axially slidable and rotatably mounted to said shaft, said shaft having a groove therein for removing foreign objects entering the space between said shaft and said axially slidable member.

16. The apparatus of claim 15, wherein said groove is a continuous circumferential groove on said shaft.

17. In a electrostatographic printing apparatus including an imaging member and a cleaning assembly, a paper detack device having a detack claw mounted on the bottom of the cleaning assembly such that the top of the claw is brought into contact with the imaging member detacking a copy sheet therefrom, said detack device including a rotatably mountable shaft supporting said detack claw, a pair of shaft support members extending downward from said cleaning assembly each having a recess in its lower coroner adjacent said imaging member for supporting said shaft and at least one elastic support member extending downward from said cleaning assembly in cooperative association with said pair of shaft support members for pressing said shaft in said recess, said detack claw being attached to a member which is axially slidable and rotatably mounted to said shaft, said shaft having a groove therein for removing foreign objects entering the space between said shaft and said axially slidable member.

18. The apparatus of claim 17, wherein said groove is a continuous circumferential groove on said shaft.

19. The apparatus of claim 17, wherein said groove is an intermittent groove on said shaft.

20. The apparatus of claim 17, wherein said groove is formed to provide a non-contact area between said shaft and the axial slidable member larger than the contact area between said shaft and the axial slidable member.

* * * * *